US006558171B2

(12) United States Patent
Igarashi et al.

(10) Patent No.: US 6,558,171 B2
(45) Date of Patent: May 6, 2003

(54) PRINTED BOARD CONNECTOR, CONTACT THEREOF AND MATING INSTRUMENT

(75) Inventors: Minoru Igarashi, Inzai (JP); Masaaki Ooya, Yokohama (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/024,014

(22) Filed: Dec. 21, 2001

(65) Prior Publication Data

US 2002/0081915 A1 Jun. 27, 2002

(30) Foreign Application Priority Data

Dec. 25, 2000 (JP) ..... 2000-393816

(51) Int. Cl.[7] ..... H01R 12/60; H01R 13/60
(52) U.S. Cl. ..... 439/83; 439/567
(58) Field of Search ..... 439/83, 395–417, 439/567

(56) References Cited

U.S. PATENT DOCUMENTS 4,645,279 A * 2/1987 Grabbe et al. ..... 439/70
5,030,107 A * 7/1991 Moon ..... 439/78
5,197,891 A * 3/1993 Tanigawa et al. ..... 439/83

FOREIGN PATENT DOCUMENTS

| | | |
|---|---|---|
| JP | 1-150376 | 10/1989 |
| JP | 7-226239 A | 8/1995 |
| JP | 8-339853 A | 12/1996 |
| JP | 10-125417 | 5/1998 |
| JP | 11-86986 A | 3/1999 |
| JP | 2000-285994 A | 10/2000 |

* cited by examiner

*Primary Examiner*—P. Austin Bradley
*Assistant Examiner*—Briggitte R. Hammond
(74) *Attorney, Agent, or Firm*—Finnegan, Henderson, Farabow, Garrett & Dunner LLP

(57) ABSTRACT

A present invention provides a printed board connector, a contact thereof and a mating instrument that prevent deterioration of electrical conductivity and spring property of contacts resulting from solder rising and/or flux rising. A printed board connector can be mounted in a printed circuit board and constitutes a mating instrument in connection with a male connector such as an insulation displacement plug. The connector has a housing and a contact arranged in the housing. The contact includes a pair of forks opposing each other, terminals capable of being soldered to the printed circuit board, and a spacer connecting terminals and the pair of forks together. The spacer provides a predetermined distance between terminals and the pair of the forks to prevent solder and/flux from rising to the forks.

17 Claims, 7 Drawing Sheets

PRINTED BOARD CONNECTOR, CONTACT THEREOF AND MATING INSTRUMENT

This application is based on patent application No. 2000-393816 filed Dec. 25, 2000 in Japan, the content of which is incorporated hereinto by reference.

BACKGROUND OF THE INVENTION

1. Field of the Invention

The present invention relates to a printed board connector capable of being mated with a male connector such as an insulation displacement plug having a cable, a contact of the printed board connector and a mating instrument. In particular, the present invention relates to improvements in the prevention of deterioration of electrical conductivity and spring property of contacts resulting from solder rising and/or flux rising which may occur when a printed board connector is mounted in a printed circuit board of electronic equipment by soldering.

2. Description of the Related Art

In electronic equipment such as cellular telephones, a mating instrument composed of an insulation displacement plug (male connector) and a printed board connector (female connector) is often used to connect two power cables of a speaker, a vibration motor, or the like, to a printed circuit board. In this case, the two power cables are fixed by insulation displacement to the insulation displacement plug respectively. The insulation displacement plug with the cables is mated with the printed board connector mounted in the printed circuit board.

With reference to FIGS. 4 to 7, conventional techniques for this kind of connectors will be described.

FIG. 4 is a plan view of an insulation displacement plug 10. FIG. 5 is a sectional view of a conventional printed board connector 20. Also, FIG. 6 shows that the insulation displacement plug 10 and the printed board connector 20 are mated with each other. FIG. 7 is a conventional contact included in the printed board connector 20.

As shown in FIG. 4, the insulation displacement plug 10 includes a plug main body 11 and a pair of insulation displacement contacts 12. The plug main body 11 is made of an insulated material and has a generally rectangular shape. The insulation displacement contacts 12 are arranged in the plug main body 11. The insulation displacement contact 12 has a base portion 13, a pair of side walls 14 extending from the base portion 13, and a contact portion 15 extending substantially in parallel with the respective side walls 14. The pair of side walls 14 have slots 16 formed therebetween. Terminals of cables 17 are pressed in the slots 16. This press-in process removes a part of sheathing 17*a* of each cable 17 to allow a core 17*b* of the cable 17 to come into contact with the corresponding side walls 14. Each contact portion 15 is exposed from the plug main body 11 and extends along the corresponding side wall of the plug main body 11. The contact portion 15 is engaged with the corresponding contact of the printed board connector 20.

The printed board connector 20 is mounted at a predetermined location of the printed circuit board. As shown in FIGS. 5 and 6, the printed board connector 20 includes a housing 22 having a chamber 21. The above described insulation displacement plug 10 is fitted into the chamber 21 of the housing 22. Each side wall of the housing 22 has a recess 23 that receives the corresponding contact portion 15 of the insulation displacement plug 10. Also, each side wall of the housing 22 has a contact 24 fixed thereto by press-in.

The contact 24 is generally L-shaped as shown in FIG. 7. That is, the contact 24 includes a base portion 25, a pair of forks 26 extending from the base portion 25 substantially in parallel with each other, and a terminal 27 extending from the base portion substantially perpendicular to each fork 26. The terminal 27 is fixed to the printed circuit board by soldering. Each fork 26 has a substantially triangular projection 28 formed on a side thereof. The projections 28 are used to fix the contact 24 to the housing 22 by press-in.

When the insulation displacement plug 10 is fitted in the chamber 21 of the printed board connector 20, the contact portion 15 of the insulation displacement contact 12 is held between the pair of forks 26 of the contact 24. The contact between the insulation displacement contact 12 and the contact 24 allows an electrical connection between the cable 17 connected to the insulation displacement plug 10 and the printed circuit board.

In the case of using a mating instrument such as the one described above, a reflow soldering device is often used to mount a printed board connector in a printed circuit board. However, during reflow soldering, surface tension of the solder may cause solder and/or flux to rise from the terminals to the pair of forks.

That is, if the printed board connector 20 is to be fixed to a printed circuit board, the bottom surface of the terminal 27 (FIG. 7) of the connector 20 is soldered to a predetermined location of the printed circuit board, as described above. At this time, solder (solder alloy) and/or flux supplied to the terminal 27 may rise beyond the base portion 25 and reach the forks 26, extending substantially perpendicular to the terminal 27. If the solder rises to the tips of the forks 26, it may degrade the spring property of the forks 26. Further, if the flux rises to the tips of the forks 26, it may deteriorate an electrical conductivity between the insulation displacement contact 12 and the contact 24.

The present invention is aimed to overcome the above-described problems and provides a printed board connector, a contact thereof, and a mating instrument that can prevent solder rising and/or flux rising so as to improve the reliability of the electric conductivity between contacts and the spring property of the contacts.

SUMMARY OF THE INVENTION

A first aspect of the present invention relates to a printed board connector capable of being mounted in a printed circuit board. This connector comprises a housing and a contact arranged in the housing. The contact includes a pair of forks opposing each other, a terminal capable of being soldered to the printed circuit board, and a spacer connecting the terminal and the pair of forks together. The spacer provides a predetermined distance between the terminal and the pair of forks to prevent solder and/or flux from rising to the forks. Accordingly, the present invention improves the reliability of the electric conductivity and the spring property of the contact.

In this specification, the "solder" essentially means both conventional tin/lead solder (Sn/Pb solder) and lead-free solder such as Sn/Ag solder.

Preferably, the spacer defines a predetermined interval between the terminal and the root of the pair of forks. This is achieved by providing the spacer with at least one folded portion. This configuration effectively prevents the solder rising and/or flux rising toward the forks.

Preferably, the terminal extend substantially perpendicular to the pair of forks. This enables another connector to engage with the printed board connector mounted in the printed circuit board, from over the printed circuit board.

Preferably, the spacer includes a base portion, a first intermediate portion, a turn-up portion and a second intermediate portion. The base portion is connected to the pair of forks. The first intermediate portion extends substantially in parallel with the forks from an end of the base portion. The end is opposite the forks. The turn-up portion is connected to the first intermediate portion. The second intermediate portion connects the turn-up portion and the terminal together. The second intermediate portion is farther from the pair of forks than the first intermediate portion. That is, the first intermediate potion is positioned between the forks and the second intermediate portion. In this configuration, solder essentially rises along a rear surface of the second intermediate portion, which is kept away from the forks. Consequently, the solder can be easily kept away from the forks.

Preferably, spaces are defined between the base portion and the terminal and between the first intermediate portion and the second intermediate portion. These spaces allow solder, which is supplied between the terminal and the printed circuit board and is likely to travel toward the forks, to be kept away from the forks.

Preferably, the second intermediate portion is branched in two directions, and the contact has two terminals connected to each branched portion of the second intermediate portion respectively. In this configuration, a predetermined interval is defined between the two terminals. The intervals (areas) allow solder to be kept away from forks.

Another aspect of the present invention provides a contact for a printed board connector. The contact comprises a pair of forks opposing each other, a terminal capable of being soldered to the printed circuit board, and a spacer connecting the terminal and the pair of forks. The spacer provides a predetermined distance between the terminal and the pair of forks to prevent solder and/or flux from rising to the forks.

A still another aspect of the present invention provides a mating instrument comprising a male connector and a female connector. The male connector has a contact portion. The female connector has a housing with a chamber which receives the male connector, and a contact arranged in the housing. The contact of the female connector includes a pair of forks opposing each other and capable of holding the contact portion of the male connector therebetween, a terminal capable of being soldered to the printed circuit board, and a spacer connecting the terminal and the pair of forks together. The spacer provides a predetermined distance between the terminal and the pair of forks to prevent solder and/or flux from rising to the forks.

The above and other objects, effects, features and advantages of the present invention will become more apparent from the following description of embodiments thereof taken in conjunction with the accompanying drawings.

DETAILED DESCRIPTION OF PREFERRED EMBODIMENTS

An embodiment of the present invention will be described below in detail with reference to the accompanying drawings.

Figure 1:
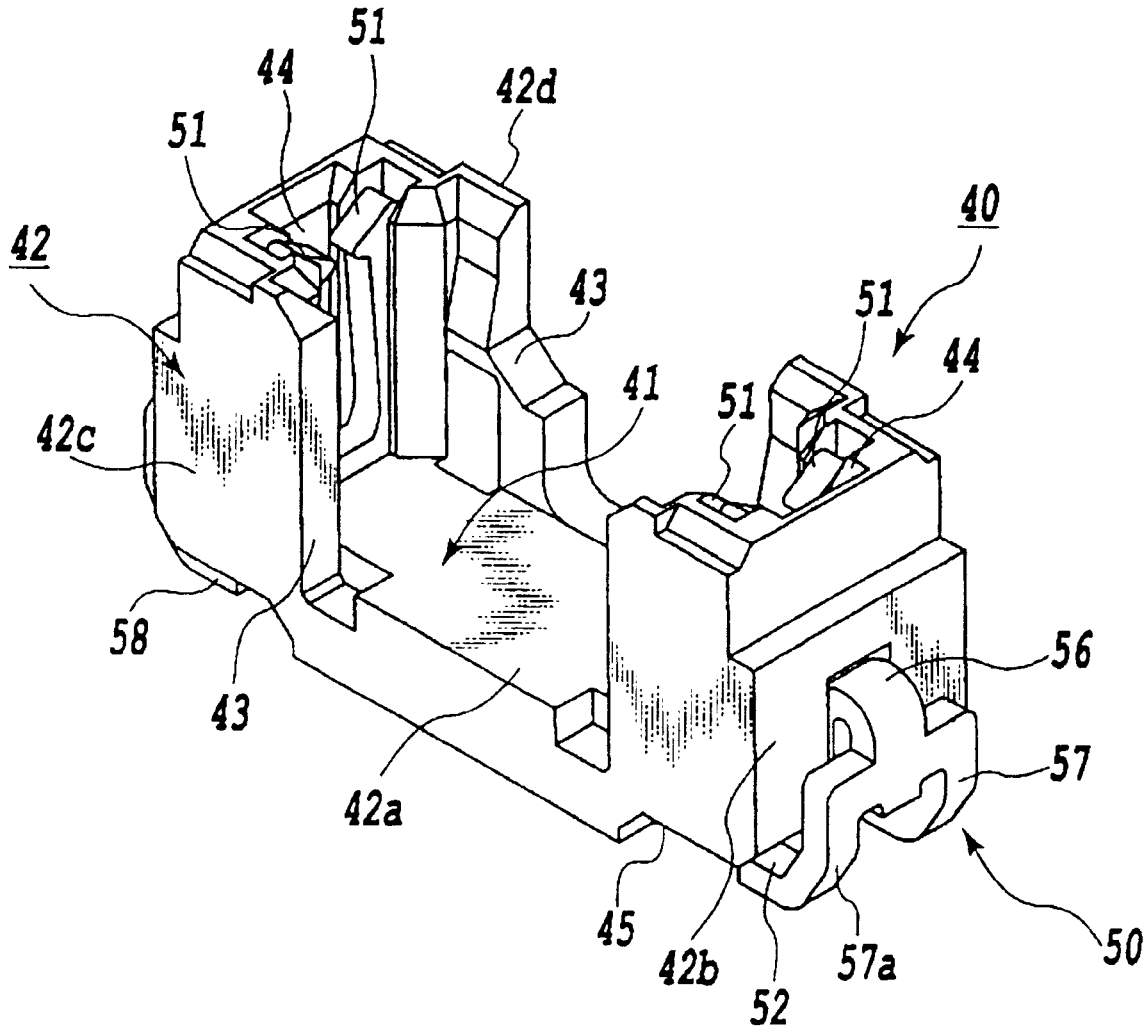
FIG. 1 is a perspective view showing an embodiment of a printed board connector according to the present invention.
Figure 2:
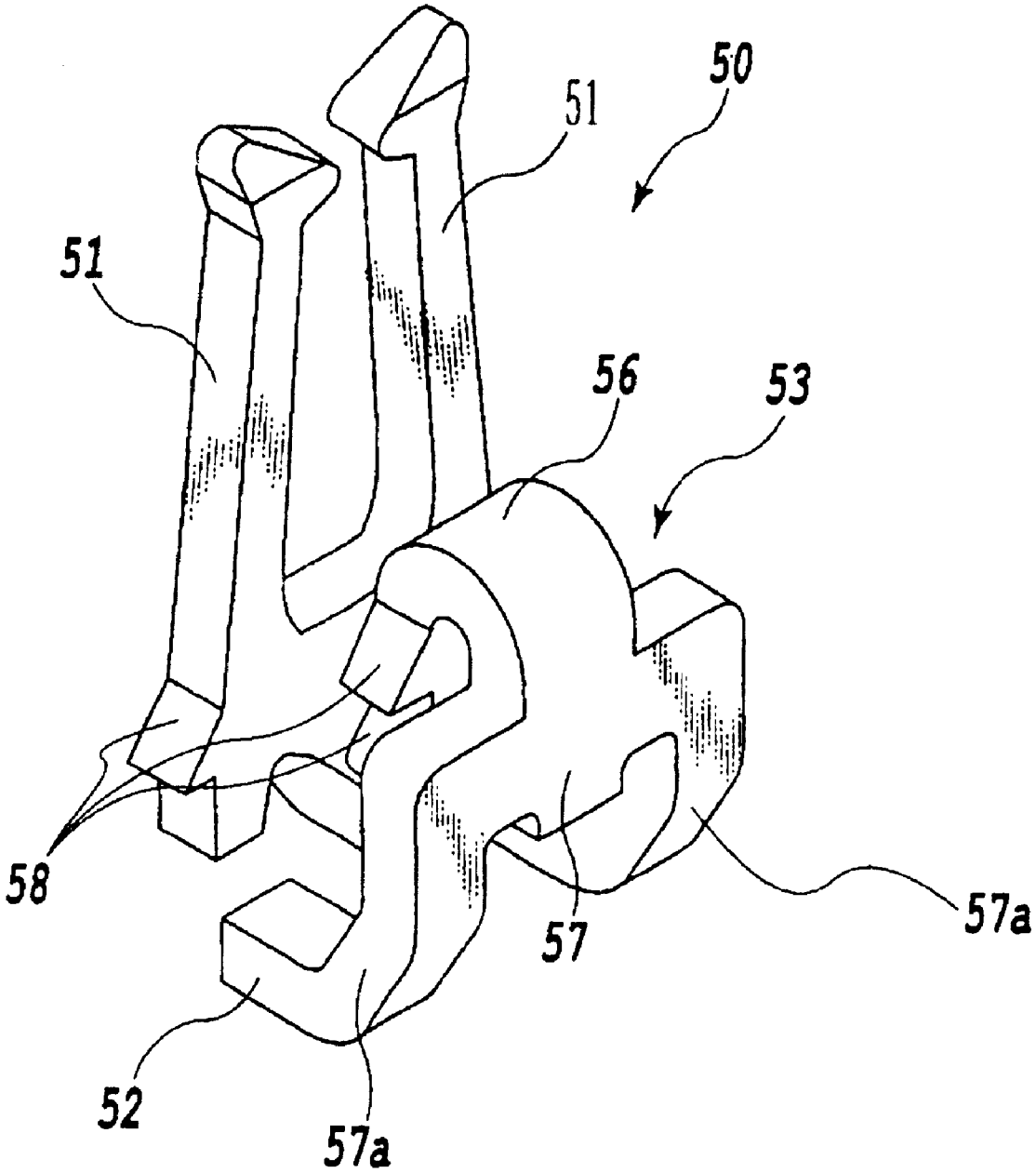
FIG. 2 is a perspective view showing a contact of the printed board connector of FIG. 1.
Figure 3:
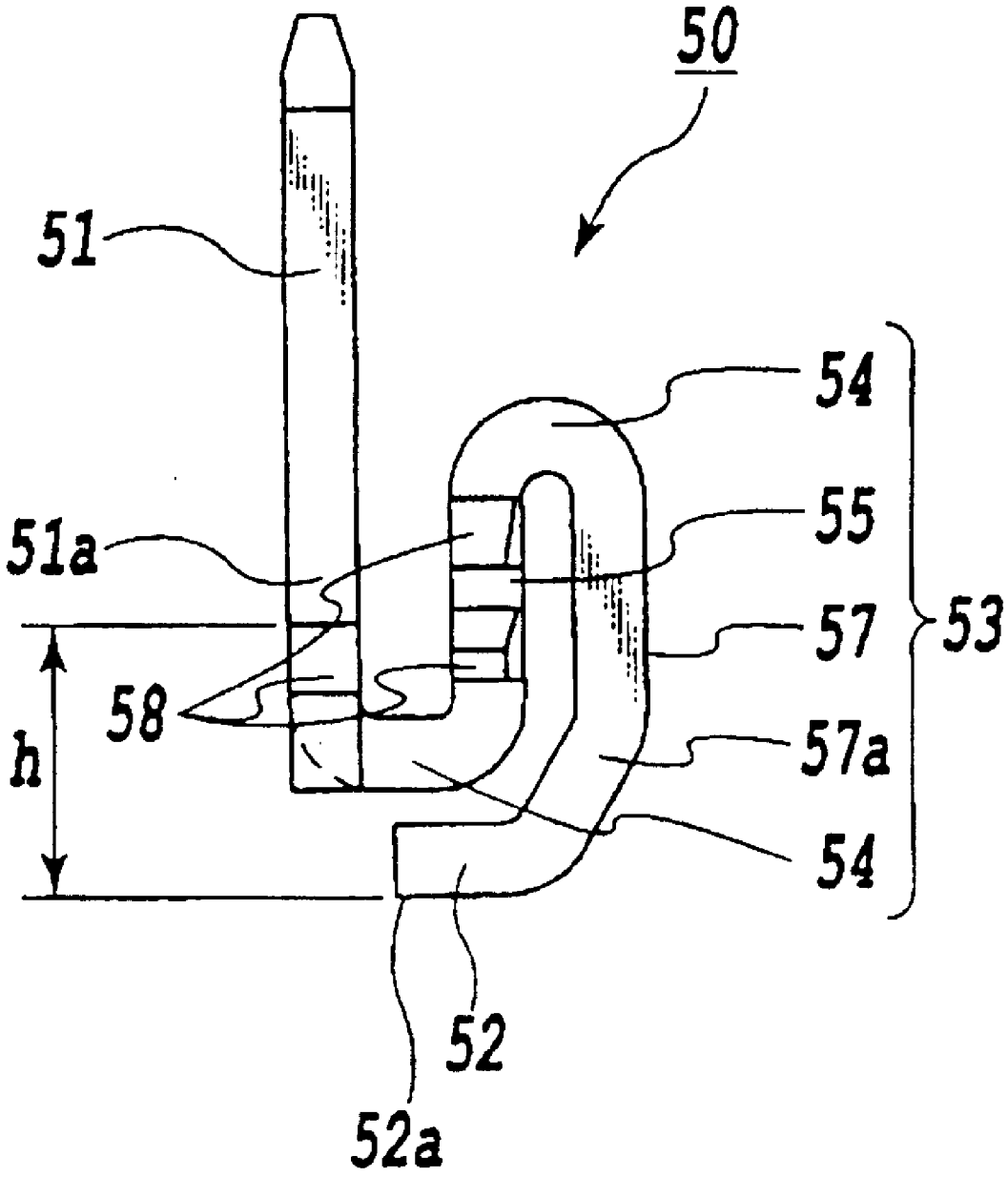
FIG. 3 is a side view of the connector of FIG. 2.

FIG. 1 shows an embodiment of a printed board connector 40 according to the present invention, and FIG. 2 shows a contact 50 included in the printed board connector 40. FIG. 3 is a side view of the contact 50.

The printed board connector 40 of FIG. 1 is a female connector that can be mounted in a printed circuit board (not shown) built into electronic equipment such as a cellular telephone. The printed board connector 40 can be mated with, for example, the insulation displacement plug 10 shown in FIG. 4. Accordingly, the printed board connector 40 can constitute a mating instrument according to the present invention, in connection with a male connector such as the insulation displacement plug 10. The detailed description of the insulation displacement plug 10 is omitted.

The printed board connector 40 includes a housing 42 having a chamber 41 which receives the male connector. The insulation displacement plug 10 shown in FIG. 4 can be fitted within the chamber 41 of the housing 42. The housing 42 has a bottom plate 42*a*, a pair of side walls 42*b*, a front and rear walls 42*c* and 42*d*, and the like. The chamber 41 is defined by a bottom plate 42*a*, side walls 42*b*, a front and rear walls 42*c* and 42*d*. Each of the front and rear walls 42*c* and 42*d* of the housing 42 has an opening 43 formed therein to prevent interference with the cables connected to the male connector (insulation displacement plug 10). Each of the side walls 42*b* of the housing 42 has a recess 44 formed therein. The recess 44 receives the contact portion of the male connector (contact portion 15 of the insulation displacement plug 10).

Furthermore, contacts 50 are fixed to the respective side walls 42*b* of the housing 42 by press-in as shown in FIG. 2. Each of the contacts 50 is integrally produced by pressing a conductive material (e.g. copper alloy) in a step-by-step manner. The contact 50 has a generally S-shaped side as shown in FIG. 3. The contact 50 includes a pair of forks 51, two terminals 52, and a spacer 53. The spacer 53 connects the pair of forks 51 and the two terminals 52 together. The contact portion of a male connector such as the insulation displacement plug 10 can be held between the pair of forks 51. Further, the two terminals 52 can be soldered to the printed circuit board.

Figure 4:
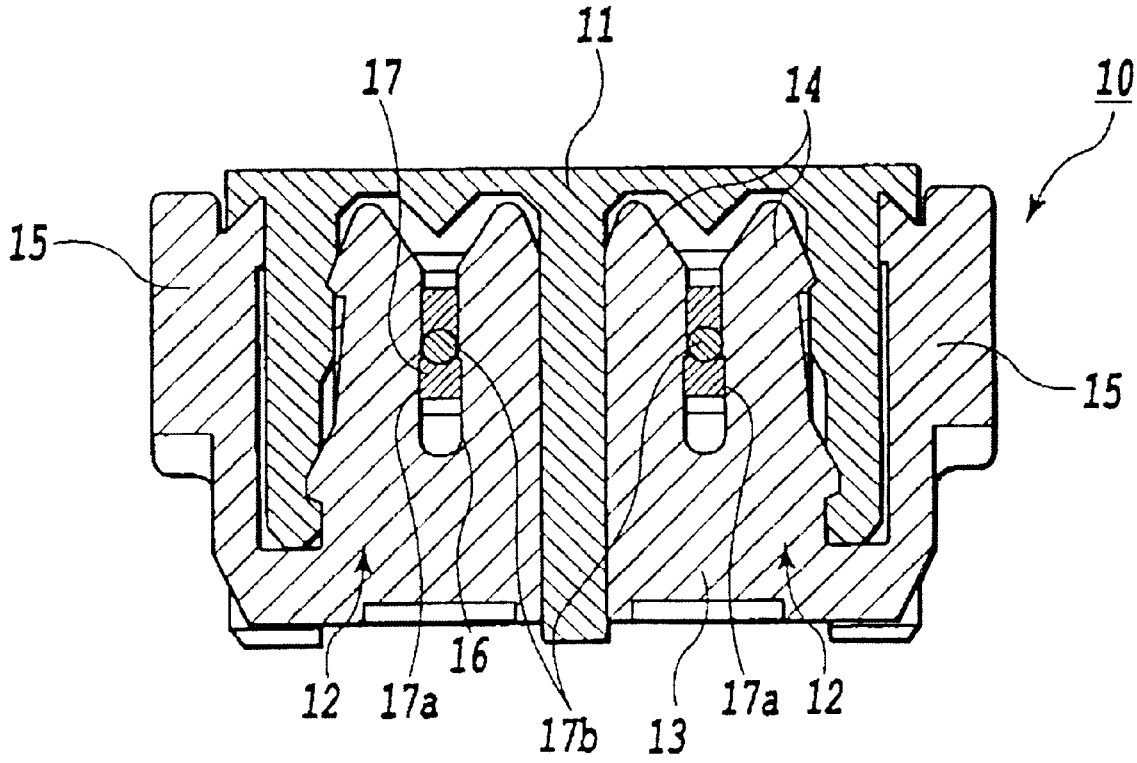
FIG.4 Prior Art
FIG. 4 is a plan view of an insulation displacement plug that can be mated with the printed board connector of FIG. 1.
Figure 5:
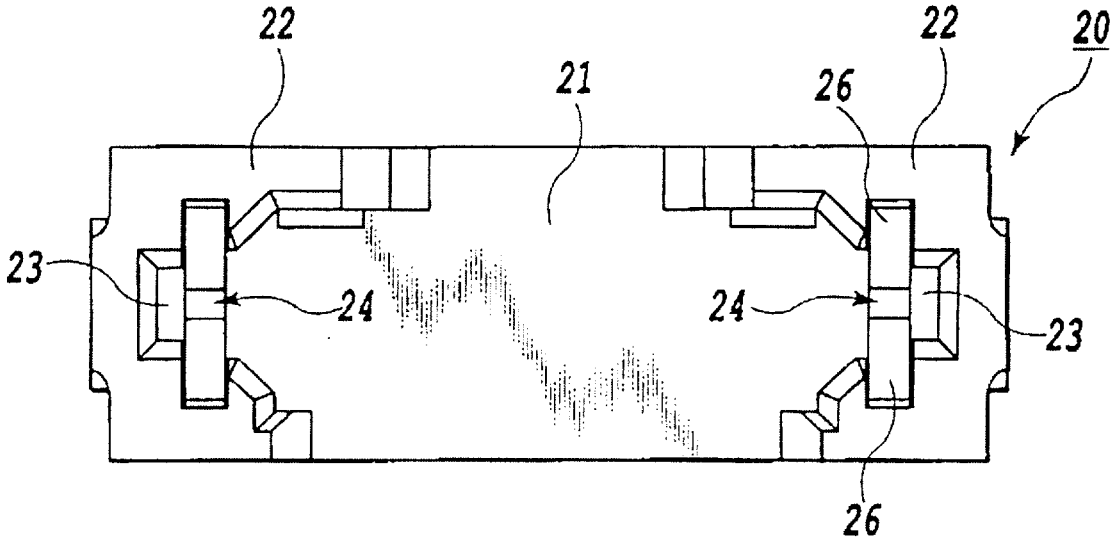
FIG.5 Prior Art
FIG. 5 is a plan view showing a conventional printed board connector.
Figure 6:
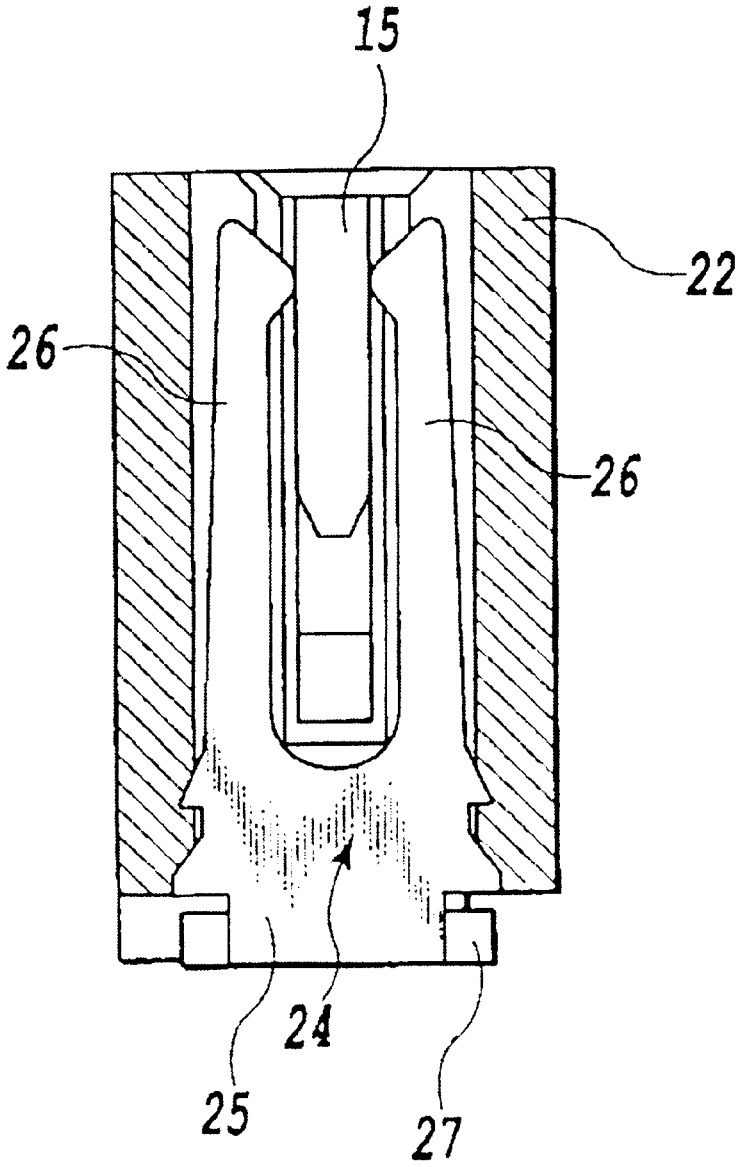
FIG.6 Prior Art
FIG. 6 is a sectional view showing the insulation displacement plug of FIG. 4 and the conventional printed board connector of FIG. 5 that are mated with each other.
Figure 7:
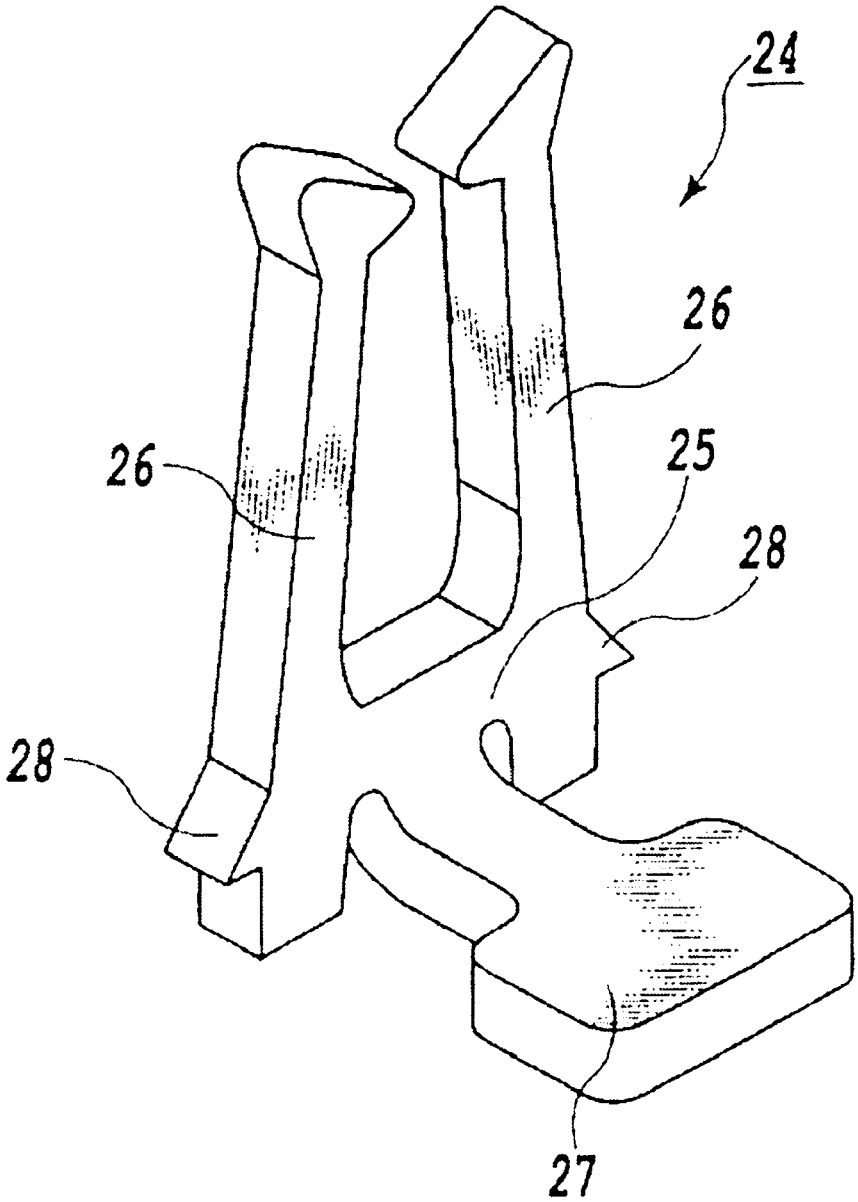
FIG.7 Prior Art
FIG. 7 is a perspective view showing a contact of the conventional printed board connector.

When the insulation displacement plug 10 shown in FIG. 4 is fitted in the chamber 41 of the printed board connector 40, each contact portion 15 of the insulation displacement plug 10 is held between the pair of forks 51. The contact between the insulation displacement contact 12 and the contact 50 allows an electrical connection between the cable 17 connected to the insulation displacement plug 10 and the printed circuit board.

As shown in FIGS. 2 and 3, the spacer 53 includes a base portion 54 connected to the pair of forks 51. The base portion 54 extends substantially perpendicular to the forks 51. A first intermediate portion 55 extends from an end of the base portion 54, the end being opposite the forks 51. The first intermediate portion 55 extends substantially parallel with the forks 51. The first intermediate portion 55 extends upward in FIG. 3 to oppose the forks 51. The first intermediate portion 55 is connected to the turn-up portion 56. The turn-up portion 56 has a generally semicircular side and connects the first intermediate portion 55 and a second intermediate portion 57. In comparison with the first intermediate portion 55, the second intermediate portion 57 is kept away from the pair of forks 51. That is, the first intermediate portion 55 is positioned between the forks 51 and the second intermediate portion 57. The second intermediate portion 57 extends substantially in parallel with the first intermediate portion 55 and the forks 51, near the turn-up portion 56. As shown in FIG. 2, the second intermediate portion 57 is branched in two directions in its middle. Each of two branched portions 57*a* of the second intermediate portion 57 are connected to the terminal 52. The terminals 52 extend substantially in parallel with the base portion 54. That is, the terminals 52 extend substantially perpendicular to the pair of forks 51.

As described above, the spacer 53 is bent at transition points between the base portion 54 and the first intermediate portion 55, between the first intermediate portion 55 and the turn-up portion 56, and between the turn-up portion 56 and the second intermediate portion 57.

Further, a root of two branched portions 57*a* of the second intermediate portion 57 is kept away from each terminal 52 by a predetermined distance in a height direction (extensional direction of forks 51). The two branched portions 57*a* of the second intermediate portion 57 are inclined toward the pair of forks 51, and the terminals 52 are located closer to the pair of forks 51 (housing 41) than the second intermediate terminal 57. When the contact 50 is mounted in the housing 42, each of the terminals 52 is fitted with a hollow portion 45 (FIG. 1) formed on the bottom of the corresponding side wall 42*b* of the housing 42. This serves to reduce the area of the printed circuit board in which the printed board connector 40 is mounted.

Generally triangular projections 58 are formed on the sides of the forks 51 and sides of the first intermediate portion 55. These projections 58 are used to fix the contact 50 to the housing 42 by press-in.

If the printed board connector 40 is to be mounted in the printed circuit board, the bottom surfaces 52*a* of the terminals 52 of the contact 50 come into contact with the printed circuit board at predetermined locations. Then, solder (and flux) is supplied between the bottom surface 52*a* of each terminal 52 and the printed circuit board. As described above, the spacer 53 provides a predetermined distance between terminals 52 and forks 51. As shown in FIG. 3, the distance is equal to the sum of the lengths of the base portion 54, the first intermediate portion 55, the turn-up portion 56, and the second intermediate portion 57. Further, the spacer 53 defines a predetermined interval h between terminals 52 and a root 51*a* of the pair of forks 51, thereby preventing the base portion 54 and root 51*a* of the contact 50 from contacting with the printed circuit board. Thus, owing to its surface tension, the solder rises along the rear surface of the second intermediate portion 57 kept away from the forks 51. Consequently, according to the printed board connector of the present invention, the solder can be kept away from the forks to reliably prevent the solder and/or flux from rising to the pair of forks 51 of the contact 50.

Further, as shown in FIG. 3, spaces are formed between the base portion 54 and terminals 52 and between the first intermediate portion 55 and the second intermediate portion 57. Furthermore, a predetermined interval (space) is defined between the two terminals 52 of the contact 50. These spaces can keep the solder away from the forks 51 even if the solder is likely to flow toward the forks 51 from between terminals 52 and the printed circuit board.

Since the terminals 52 of the printed board connector 40 extend substantially perpendicular to the pair of forks 51, a male connector such as the insulation displacement plug 10 can be mated with the printed board connector 40 mounted in the printed circuit board, from over the printed circuit board.

In the above described printed board connector 40, the spacer 53 provides a sufficiently long distance between terminals 52 and the pair of the forks 51, thereby preventing the solder and/or flux from rising to the forks 51. Consequently, the present invention can improve the reliability of the electrical connection between the contacts 50 and 12 and the spring property of contacts 50.

The spacer 53, including the base portion 54, the first intermediate portion 55, the turn-up portion 56, and the second intermediate portion 57, can provide a sufficient length between terminals 52 and the pair of forks 51 without any substantial increase in the mounting area of the connector 40.

Further, the predetermined interval h (FIG. 3) between terminals 52 and the root 51*a* of the pair of the forks 51 can be obtained by providing the spacer 53 with at least one bent portion. That is, the first intermediate portion 55 and the turn-up portion 56 can be omitted, and the base portion 54 may be connected directly to the second intermediate portion 57 (branched portion 57*a*). This also prevents the solder and/flux from rising to the forks 51.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printed board connector capable of being mounted in a printed circuit board, said printed board connector comprising:

a housing; and a contact arranged in said housing, said contact including a pair of forks opposing each other, a terminal capable of being soldered to said printed circuit board, and a spacer connecting said terminal and said pair of forks together, said spacer providing a predetermined distance between said terminal and said pair of forks to prevent mounting material from rising to said forks;

wherein said spacer includes a base portion connected to said pair of forks; a first intermediate portion extending substantially in parallel with said forks from an end of said base portion, said end being opposite said forks; a turn-up portion connected to said first intermediate portion; and a second intermediate portion connecting said turn-up portion and said terminal together, said second intermediate portion being farther from said pair of forks than said first intermediate portion.

2. The printed board connector as claimed in claim 1, wherein spaces are defined between said base portion and said terminal and between said first intermediate portion and said second intermediate portion.

3. The printed board connector as claimed in claim 1, wherein said second intermediate portion is branched in two directions, and said contact has two terminals connected to each branched portion of said second intermediate portion respectively.

4. The printed board connector as claimed in claim 1, wherein said spacer defines a predetermined interval between said terminal and a root portion of said pair of forks.

5. The printed board connector as claimed in claim 4, wherein said terminal extends substantially perpendicular to said pair of forks.

6. A contact for a printed board connector comprising:

a pair of forks opposing each other;

a terminal capable of being soldered to a printed circuit board; and a spacer connecting said terminal and said pair of forks together, said spacer providing a predetermined distance between said terminal and said pair of forks to prevent mounting material from rising to said forks;

wherein said spacer includes a base portion connected to said pair of forks; a first intermediate portion extending substantially in parallel with said forks from an end of said base portion, said end being opposite said forks; a turn-up portion connected to said first intermediate portion; and a second intermediate portion connecting said turn-up portion and said terminal together, said second intermediate portion being farther from said pair of forks than said first intermediate portion.

7. The contact as claimed in claims 6, wherein spaces are defined between said base portion and said terminal and between said first intermediate portion and said second intermediate portion.

8. The contact as claimed in claim 6, wherein said second intermediate portion is branched in two directions, and said contact has two terminals connected to each branched portion of said second intermediate portion respectively.

9. The contact as claimed in claim 6, wherein said spacer defines a predetermined interval between said terminal and a root portion of said pair of forks.

10. The contact as claimed in claim 9, wherein said terminal extends substantially perpendicular to said pair of forks.

11. A mating instrument comprising:

a male connector having a contact portion; and a female connector having a housing with a chamber which receives said male connector, and a contact arranged in said housing, said contact including a pair of forks opposing each other and capable of holding said contact portion of said male connector therebetween, a terminal capable of being soldered to said printed circuit board, and a spacer connecting said terminal and said pair of forks together, said spacer providing a predetermined distance between said terminal and said pair of forks to prevent mounting material from rising to said forks;

wherein said spacer includes a base portion connected to said pair of forks; a first intermediate portion extending substantially in parallel with said forks from an end of said base portion, said end being opposite said forks; a turn-up portion connected to said first intermediate portion; and a second intermediate portion connecting said turn-up portion and said terminal together, said second intermediate portion being farther from said pair of forks than said first intermediate portion.

12. The mating instrument as claimed in claim 11, wherein spaces are formed between said base portion and said terminal and between said first intermediate portion and said second intermediate portion.

13. The mating instrument as claimed in claim 11, wherein said second intermediate portion is branched in two directions, and said contact has two terminals connected to each branched portion of said second intermediate portion respectively.

14. The mating instrument as claimed in claim 11, wherein said female connector is a printed board connector.

15. The mating instrument as claimed in claim 11, wherein said spacer defines a predetermined interval between said terminal and a root portion of said pair of forks.

16. The mating instrument as claimed in claim 15, wherein said terminal extends substantially perpendicular to said pair of forks.

17. The mating instrument as claimed in claim 15, wherein said male connector is an insulation displacement plug.

* * * * *